US008523125B1

(12) United States Patent
Jardine

(10) Patent No.: US 8,523,125 B1
(45) Date of Patent: Sep. 3, 2013

(54) MOUNTABLE SOAP DISH

(76) Inventor: Colin Jardine, St. Albans, NY (US)

( * ) Notice: Subject to any disclaimer, the term of this patent is extended or adjusted under 35 U.S.C. 154(b) by 18 days.

(21) Appl. No.: 12/770,546

(22) Filed: Apr. 29, 2010

(51) Int. Cl.
*A47K 5/08* (2006.01)
*A47K 1/04* (2006.01)
*A47F 7/00* (2006.01)

(52) U.S. Cl.
USPC ..... 248/205.3; 211/85.12; 4/628; 206/77.1

(58) Field of Classification Search
USPC ..... 206/77.1; 211/85.12; 248/311.2, 248/205.3; 4/628; D6/536, 540
See application file for complete search history.

(56) References Cited

U.S. PATENT DOCUMENTS

| | | | | | |
|---|---|---|---|---|---|
| 1,248,522 | A | | 12/1917 | Mentel | |
| D137,908 | S | * | 5/1944 | Beneto | D6/536 |
| D141,011 | S | * | 4/1945 | Madan | D6/536 |
| D224,028 | S | * | 6/1972 | Settle | D6/536 |
| D228,843 | S | * | 10/1973 | Settle | D6/536 |
| D252,841 | S | * | 9/1979 | Koh | D6/536 |
| 4,277,042 | A | | 7/1981 | Ash, Sr. | |
| 4,331,232 | A | * | 5/1982 | Larkin | 206/77.1 |
| D312,740 | S | * | 12/1990 | Greenhut et al. | D6/536 |
| 4,993,546 | A | | 2/1991 | Southard | |
| 5,181,606 | A | | 1/1993 | Martell | |
| D385,137 | S | | 10/1997 | von Seidel | |
| 5,680,929 | A | * | 10/1997 | Von Seidel | 206/77.1 |
| 5,761,752 | A | * | 6/1998 | Blake | 4/559 |
| 5,947,272 | A | | 9/1999 | Park | |
| 7,424,949 | B2 | | 9/2008 | Kumar | |
| 2005/0211575 | A1 | * | 9/2005 | Li | 206/77.1 |

FOREIGN PATENT DOCUMENTS

| | | |
|---|---|---|
| GB | 8778 | 5/1916 |
| GB | 638.408 | 6/1950 |
| GB | 1.330.111 | 9/1973 |

* cited by examiner

*Primary Examiner* — J. Gregory Pickett
*Assistant Examiner* — Kaushikkumar Desai
(74) *Attorney, Agent, or Firm* — Michael I. Kroll

(57) ABSTRACT

A structure mountable soap disk having a back wall support portion and a downwardly cantilevered bar soap receptacle portion with the soap bar receptacle portion having side and front wall with at least one aperture for water to drain therethrough.

13 Claims, 8 Drawing Sheets

MOUNTABLE SOAP DISH

BACKGROUND OF THE INVENTION

1. Field of the Invention

Figure 1:
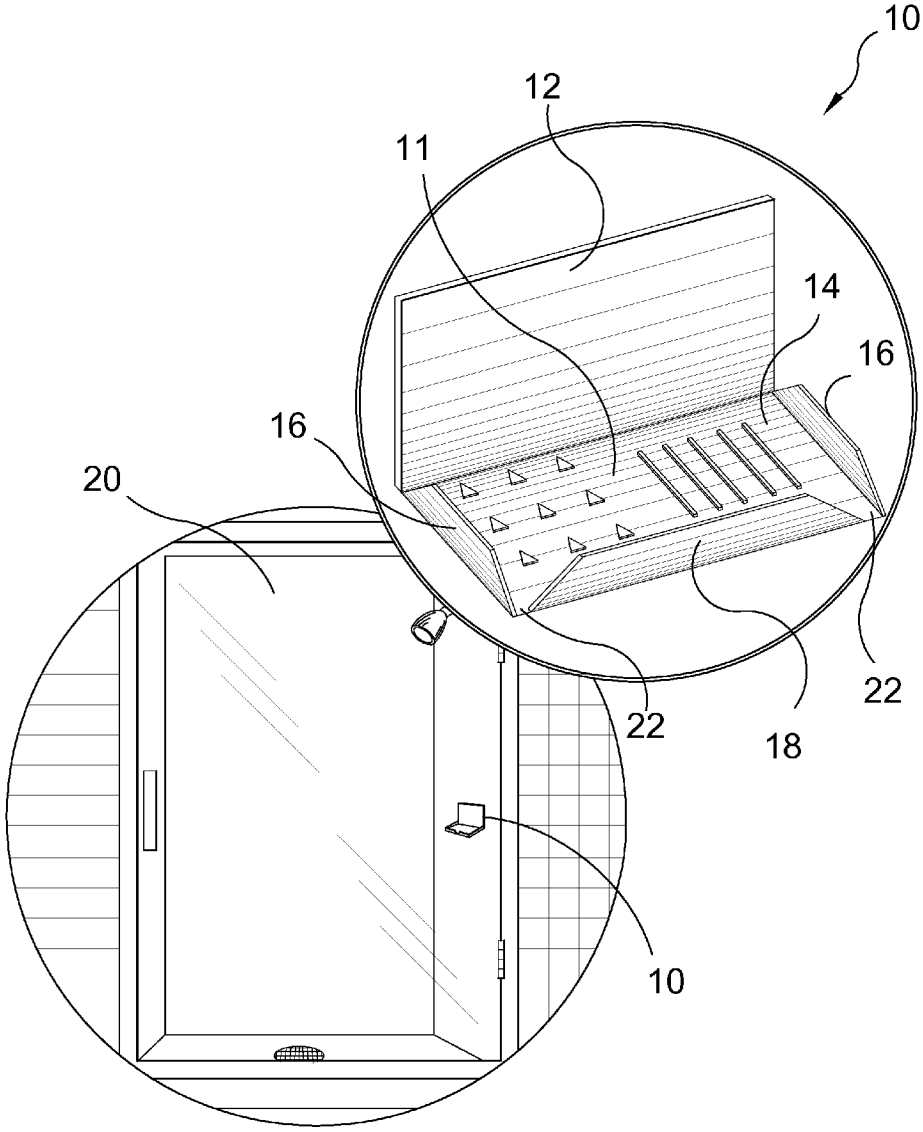

The present invention relates generally to receptacles and, more specifically to a soap dish mountable to a structure.

The structure mountable soap disk comprises a back wall support portion that can be mounted to a structure by any means known with the art.

Downwardly cantilevered from the back wall is a bar soap receptacle plate having side walls and a front wall extending therebetween. Within the front wall is at least one aperture for the drainage of water therethrough. The soap dish can be installed within a tub enclosure or shower stall 2. Description of the Prior Art There are other receptacle designed for bar soap. Typical of these is U.S. Pat. No. 1,248,522 issued to Mentel on Dec. 4, 1917.

Another patent was issued to Settle on Jun. 27, 1972 as U.S. Pat. No. Des. 224,028. Yet another U.S. Pat. No. 4,277,042 was issued to Ash, Sr. on Jul. 7, 1981 and still yet another was issued on Feb. 19, 1991 to Southard as U.S. Pat. No. 4,993, 546.

Another patent was issued to Martell on Jan. 26, 1993 as U.S. Pat. No. 5,181,606. Yet another U.S. Pat. No. Des. 385, 137 was issued to von Seidel Oct. 21, 1997. Another was issued to von Seidel on Oct. 28, 1997 as U.S. Pat. No. 5,680, 929 and still yet another was issued on Sep. 7, 1999 to Youngkeun Park as U.S. Pat. No. 5,947,272.

Another patent was issued to Kumar on Sep. 16, 2008 as U.S. Pat. No. 7,424,949. Yet another U.K. Patent No. GB 8778 was published to Wells on May 11, 1916. Another was issued to Ferguson on Jun. 7, 1950 as U.K. Patent No. GB 638,408 and still yet another was published on Sep. 12, 1973 to Cesana as U.K. Patent No. GB 1 330 111.

A reversible soap dish having side walls on each side, long and short legs for supporting one of said sides uppermost, a back for one of said sides and a spring adapted to coact with said back to form means for clamping said dish on a bucket to hold the other side uppermost.

The ornamental design for a soap receptacle, substantially as shown and described in the design patent.

A receptacle in the shape of a steeply-inclined chute formed of a slick material and having a pair of rungs supported by ribs which extend generally upward from below the lower front edge of the chute to substantially its upper edge. The rungs are in contact with the lower surface of a bar of soap deposited in the receptacle, and the ribs support the bar out of contact with the inclined bottom wall of the chute. No surface of a rectangular bar of soap, when placed in the receptacle, is disposed in a generally horizontal position, thus facilitating the drainage of water away from the soap. Further, the contact between the receptacle and the least sloping surface of the bar of soap, that is, the contact between it and the rung, is minimized by having the plane of the upper surface of each rung generally forming an acute angle with the inclined bottom wall of the chute. In use, the lower front edge of the chute is disposed below the edge of the ledge of a sink basin to which the base of the receptacle is affixed by adhesive. The proximity of the chute to the sink basin allows a user to transfer a bar of soap to and from the receptacle without dripping water or suds on the ledge. The chute may be attached to the base by means of projections on the underside of the chute which are slidably mounted upon the walls of the base so that the chute can be removed for rinsing without disturbing the base.

A soap dish construction including a planar rear wall with an integral floor and generally S-shaped sides, each of the sides includes a forward portion directed interiorly of a rear portion wherein the forward portion projects beyond and below the floor. The floor includes a tapered upper surface to direct fluid directed up to the upper surface towards the forward portion of the side walls defining a trough including a trough floor. The trough floor angulates forwardly and downwardly relative to the inclined upper surface of the floor and is generally coextensively arranged therewith. The upper surface of the floor includes a plurality of spaced ribs defined by a predetermined spacing therebetween. A modified construction of the invention includes a tool receivable within a slot within the dish construction where a tool is defined by a first leg of a width substantially equal to the predetermined spacing between the upstanding ribs.

A soap dish is made of ribs that are shaped to allow a user to pick up a bar of soap in a single grasp without lifting the soap over a rim or lip. The soap dish is also shaped to hold the soap in a stable and stationary position when the user puts the soap in the dish and to permit adequate drainage of water and soap residue. The ribs form the support surface for the soap, so that the soap rests on the top edges of the ribs. Each of the ribs has a portion that slopes up to form with the other ribs a valley that keeps the soap in the dish. The soap dish has a weighted base to increase its stability and a trough to direct water and soap residue away from the soap dish. The dimensions and arrangement of the soap dish are particularly appropriate for maximum ease of manufacture by injection molding of an acrylic material in a minimum number of separate components.

The ornamental design for a soap dish, as shown and described in the design patent drawings.

A soap dish is provided in which the bottom of the dish is impervious and slopes downwardly at an angle of at least 3.degree. to a front drainage discharge zone, having a lip extending downwardly below the support plane of the dish so that, in use, it extends into a sink, basin or bath. Soap support formations, conveniently rearwardly extending ribs, extend upwardly from the bottom and define at the upper ends a soap support plane inclined rearwardly towards the rear wall and spaced upwardly from the bottom. The rear wall has forwardly projecting stops, conveniently formed as extensions of soap supporting ribs to prevent direct contact between a cake of soap and the rear wall.

A soap case having a receiving portion for receiving a bar of soap, the soap case characterized in that the receiving portion has a width wider than the thickness of the bar of soap and narrower than the width of the bar of soap such that the bar of soap can be received in a standing position as a pair of relatively wider surfaces of the bar of soap face both side surfaces of the receiving portion, and a depth sufficient for the bar of soap to stably stand upright, and comprises side surfaces each being curved of which the effective contact portions actually contacting the bar of soap being received becomes narrower towards the bottom of the case, a front surface for supporting the received bar of soap to stably stand upright, a rim surface of a curved shape forming the upper portion of the side surfaces and the front surface, and a bottom surface of a curved shape sloped at a predetermined angle-.sub.—downwards with respect to the receiving direction of a bar of soap, and the both side surfaces, the front surface, the rim surface and the bottom surface are curved, so that the bar of soap preferably makes point-contact with both the side surfaces, the front surface, the rim surface and the bottom surface. Thus, the water left on the surfaces of the bar of soap rapidly flows down so that the bar of soap is dries quickly, and the bar of soap does not soften and dries quickly due to the smooth ventilation of air around the bar of soap.

The novel concept of a single embodiment, namely a self-draining soap dish unit fabricated with choice of materials, metals, sizes, shapes, styles, including the options for accessories, securable to fixed structure, in which the soap held in the container component of the unit is repositioned, by means of one or more integrated mechanisms, such as telescopic arm, pivoted leaver, hydraulic, hinge, pneumatic, motor, solenoids, springs and inclined plane, to a preferred location, such as sink, tub or shower floor, to enhance drying function of the soap, during use and thereafter, allowing water from the wet soap to drain into the preferred area and be eliminated, thus drying the soap effectively and efficiently, and is returned to its original position in the soap dish. The combined structural construction and functional elements of this single embodiment to enhance the drying feature of the soap makes this soap dish unit, unique and innovative.

A sheet metal soap-box or tray in which the soap lies upon an inclined surface which has downward channels formed therein, and the back of the soap rests against a surface which preferably, has also downward channels formed therein, moisture from the soap flowing down the channels and into a well below.

A soap holder comprises four glazed tiles 1 assembled to form a box and held in position by an enclosed bed of cement 2 which forms the base of the holder and on which a fifth tile is secured in a sloping position. If the edges of the tile are unglazed the exposed edges are painted with enamel paint. The Provisional Specification states that the assembling of the tiles is done in a mould.

A soap dish comprises a tray 1 formed with openings 11 in its base and a reservoir 2 removably attached to the underside of the tray. The reservoir is attached to the cylindrical flange 13 by a screw thread. The soap is supported above the tray on ribs 12.

While these soap dishes may be suitable for the purposes for which they were designed, they would not be as suitable for the purposes of the present invention, as hereinafter described.

SUMMARY OF THE PRESENT INVENTION

A primary object of the present invention is to provide a mountable soap dish having a back wall and a downwardly cantilevered soap bar receptacle plate.

Another object of the present invention is to provide a mountable soap dish wherein said back wall and cantilevered soap receptacle plate form a unitary soap dish.

Yet another object of the present invention is to provide a mountable soap dish wherein said soap bar receptacle has a pair of side walls extending from the back wall to the front edge of the receptacle plate.

Still yet another object of the present invention is to provide a mountable soap dish wherein said soap bar receptacle plate has a front wall extending vertically between the side walls.

An additional object of the present invention is to provide a mountable soap dish wherein said soap bar receptacle front wall has at least one aperture for draining water therethrough.

A further object of the present invention is to provide a mountable soap dish wherein said soap bar receptacle front wall aperture is approximately centrally disposed.

A yet further object of the present invention is to provide a mountable soap dish wherein said soap bar receptacle front wall has a pair of apertures positioned on each end of said front wall.

A still yet further object of the present invention is to provide a mountable soap dish wherein said soap bar receptacle front wall aperture diverges from the base to the top of said front wall.

Another object of the present invention is to provide a mountable soap dish wherein said side walls have apertures on the front and rear with each side wall having a trapezoidal shape.

Yet another object of the present invention is to provide a mountable soap dish wherein said front wall having apertures on opposing sides has a trapezoidal shape.

Additional objects of the present invention will appear as the description proceeds.

The present invention overcomes the shortcomings of the prior art by providing a structure mountable soap disk having a back wall support portion and a downwardly cantilevered bar soap receptacle portion with the soap bar receptacle portion having side and front wall with at least one aperture for water to drain therthrough.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

Figure 2:
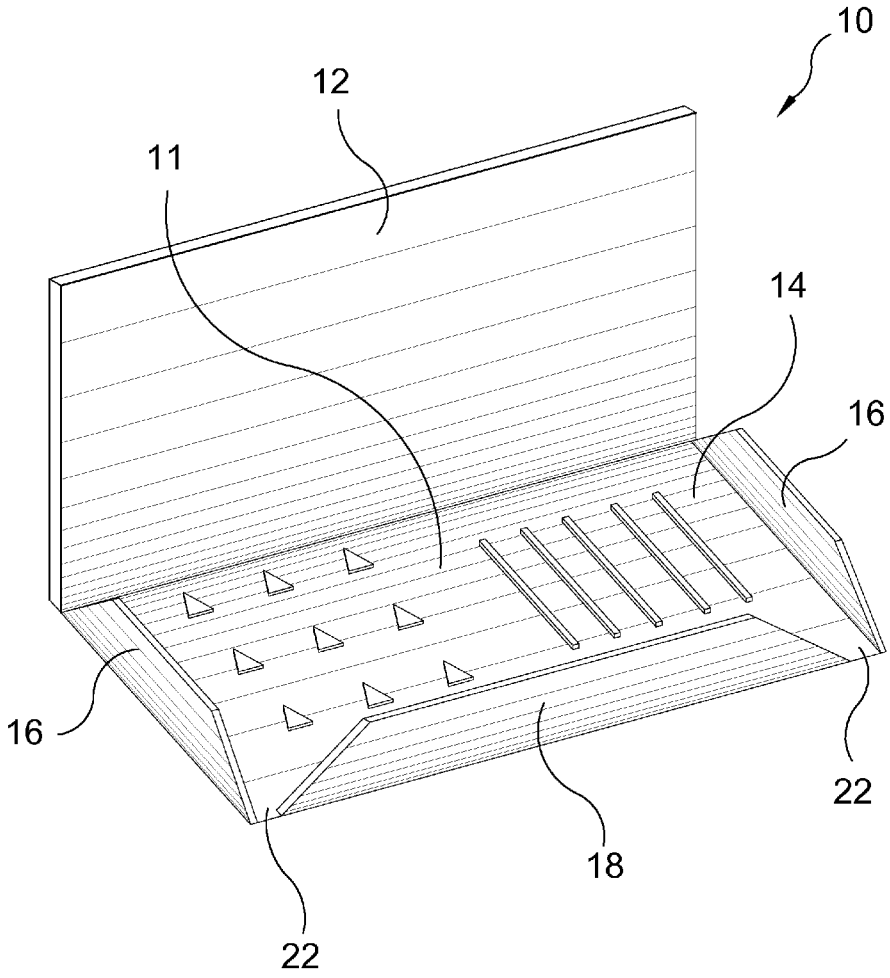
Figure 3:
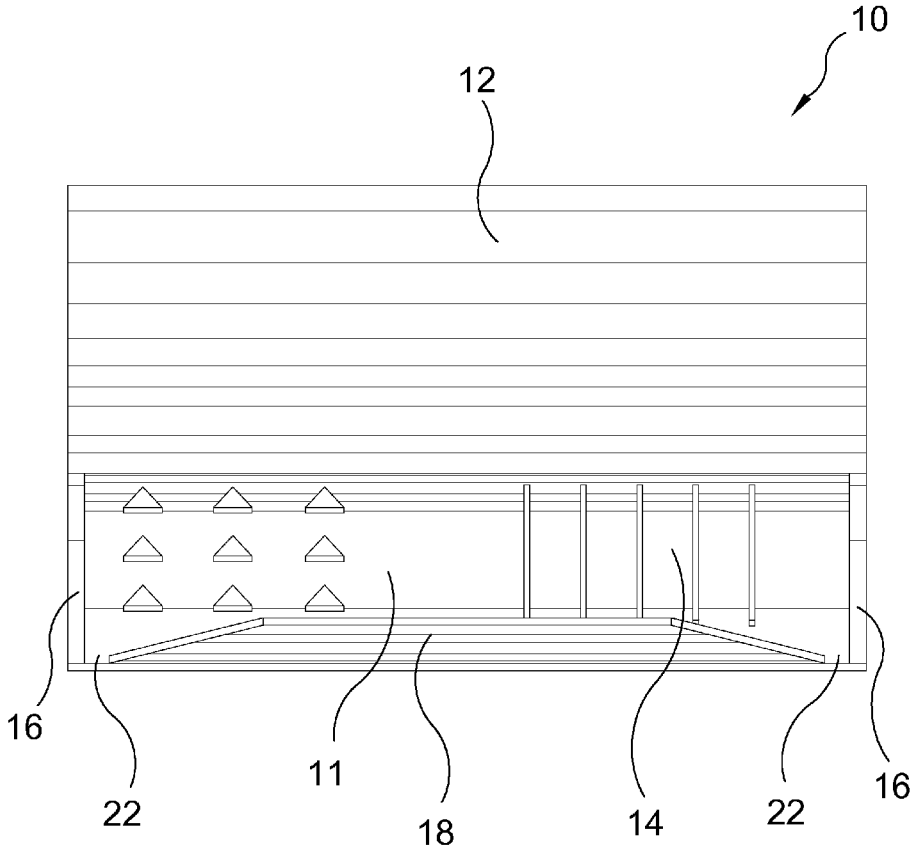
Figure 4:
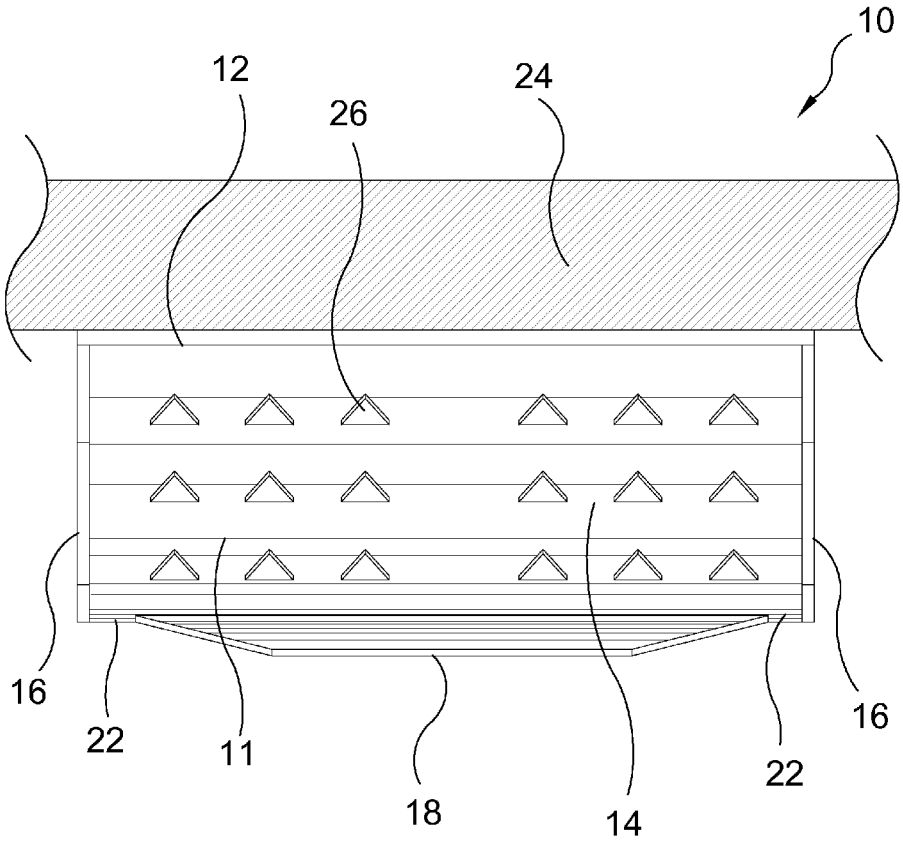
Figure 5:
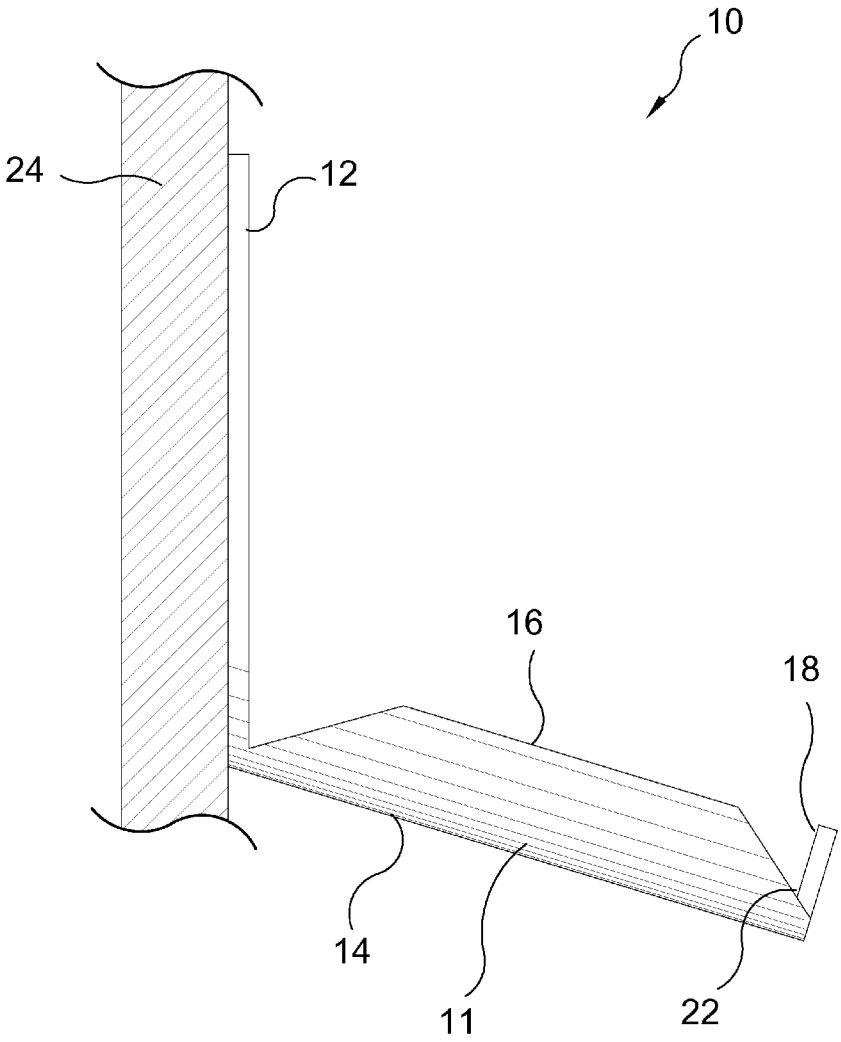
Figure 6:
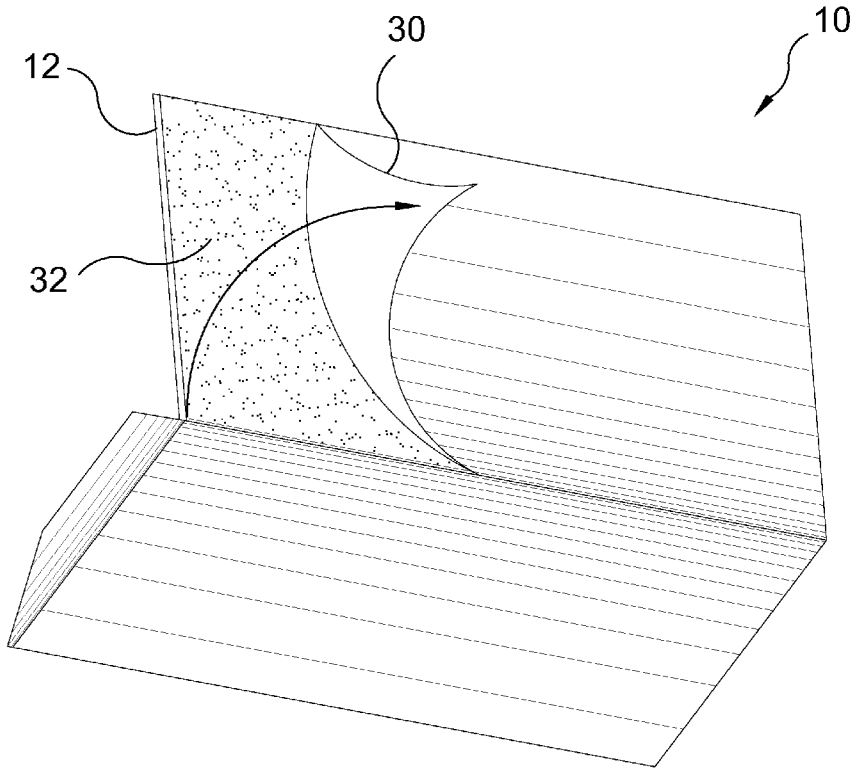
Figure 7:
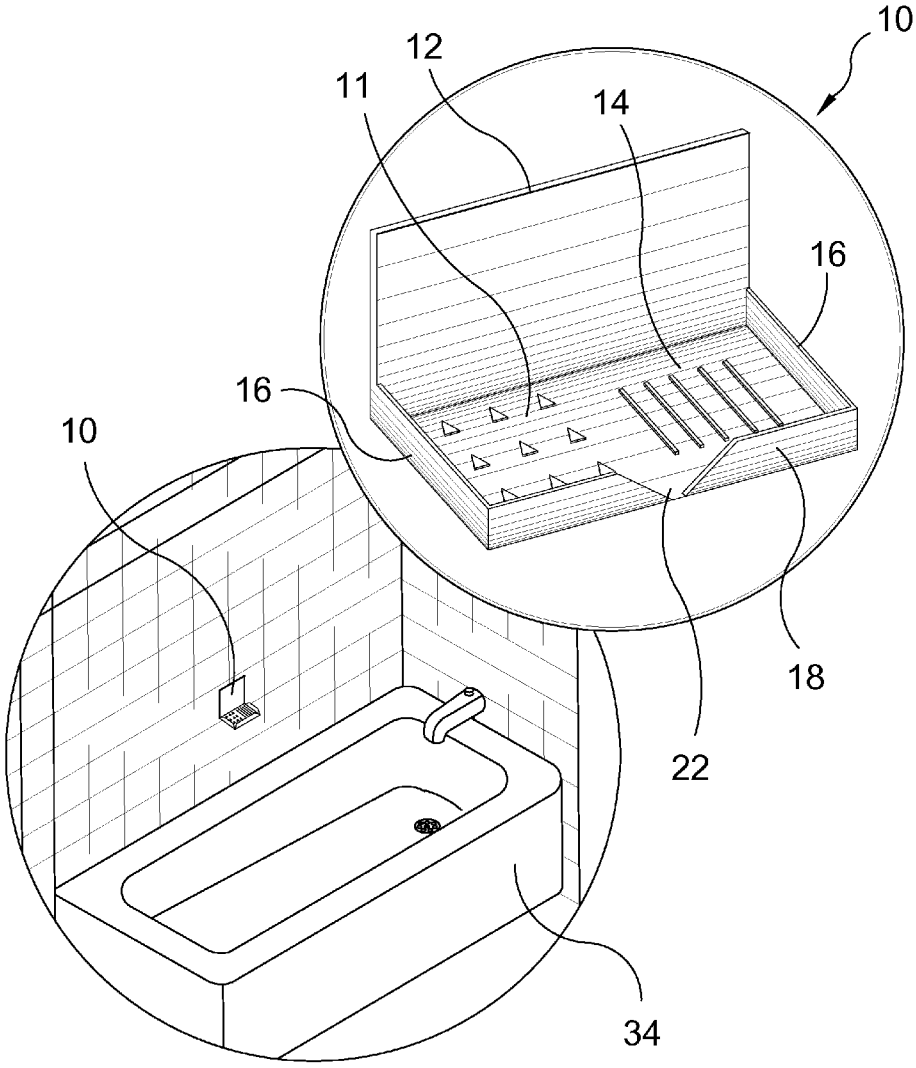
Figure 8:
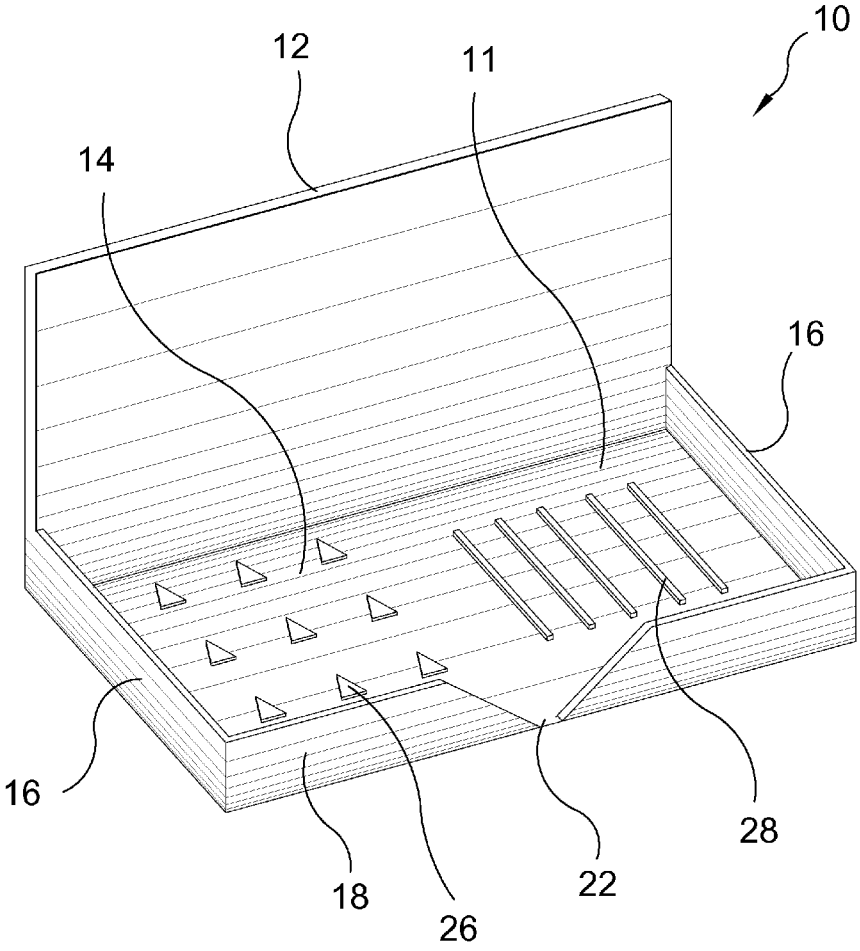

In order that the invention may be more fully understood, it will now be described, by way of example, with reference to the accompanying drawing in which:

FIG. 1 is an illustrative view of the mountable soap in use.
FIG. 2 is an illustrative view of the present invention.
FIG. 3 is a front view of the present invention.
FIG. 4 is a top view of the present invention.
FIG. 5 is a side view of the present invention.
FIG. 6 is a back view of the present invention.
FIG. 7 is a perspective view of the present invention.
FIG. 8 is a perspective view of the present invention.

DESCRIPTION OF THE REFERENCED NUMERALS

Turning now descriptively to the drawings, in which similar reference characters denote similar elements throughout the several views, the figures illustrate the Mountable Cantilevered Soap Dish of the present invention. With regard to the reference numerals used, the following numbering is used throughout the various drawing figures.

10 Mountable Cantilevered Soap Dish of the present invention
11 soap receptacle
12 back support plate
14 soap receptacle plate
16 side lip
18 front lip
20 shower stall

22 water egress recess
24 wall structure
26 triangular protrusion
28 linear protrusion
30 peel off backing
32 adhesive element
34 bathtub

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 shown is an illustrated view of the mountable soap dish 10 in use. The present invention provides a cantilevered soap dish 10 having a back wall support portion 12 that is mountable to a structure, using any means well known within the art, with a soap bar receptacle plate 14 angularly depending from the back wall support 12. The soap bar receptacle plate 14 has opposing side lips 16 with a front lip 18 extending therebetween. The front lip 18 provides for at least one water egress recess 22 for water to drain from the soap receptacle 11. As illustrated the soap dish 10 can be mounted for bath tub use or shower stall 20 use.

FIG. 2 is an illustrative view of the mountable soap dish 10. The present invention provides a cantilevered soap dish 10 having a back wall support portion 12 that is mountable to a structure, using any means well known within the art, with a soap bar receptacle plate 14 angularly depending from the back wall support 12. The soap bar receptacle 11 has opposing side lips 16 with a front lip 18 extending therebetween. The front lip 18 provides for at least one water egress recess 22 for water to drain from the soap receptacle portion.

FIG. 3 is a front view of the mountable soap dish 10. The present invention provides a cantilevered soap dish 10 having a back wall support portion 12 that is mountable to a structure, using any means well known within the art, with a soap bar receptacle plate 14 angularly depending from the back wall support 12. The soap bar receptacle 11 has opposing side lips 16 with a front lip 18 extending therebetween. The front lip 18 provides for at least one water egress recess 22 for water to drain from the soap receptacle portion 14.

FIG. 4 is a top view of the mountable soap dish 10 in use. The present invention provides a cantilevered soap dish 10 having a back wall support portion 12 that is mountable to a structure, using any means well known within the art, with a soap bar receptacle plate 14 angularly depending from the back wall support 12. The soap bar receptacle 14 has opposing side lips 16 with a front lip 18 extending therebetween. The front lip 18 provides for at least one water egress recess 22 for water to drain from the soap receptacle 11. As illustrated the soap dish can be mounted on the wall 24 for bath tub use or shower stall use. Also provided a triangular protrusions 26 disposed on the top surface of the receptacle plate 14.

FIG. 5 is a side view of the present invention 10. The present invention provides a cantilevered soap dish having a back wall support portion 12 that is mountable to a structure 24, using any means well known within the art, with a soap bar receptacle plate 14 angularity depending from the back wall support 12. The soap bar receptacle 11 has opposing side lips 16 with a front side lip 18 extending therebetween. The front side lip 18 provides for at least one water egress recess 22 for water to drain from the soap receptacle 11. As illustrated the soap dish can be mounted to the wall 24 for bath tub use or shower stall use.

FIG. 6 is a back view of the present invention 10. The present invention provides a mountable cantilevered soap dish 10 having a back wall support 12 that is mountable to a structure, using any means well known within the art. Shown is a mounting method wherein the rear portion of the back wall support 12 has a peel off backing 30 that when removed exposes an adhesive element 32 for mounting to a wall structure.

FIG. 7 shown is an illustrated view of the mountable soap dish 10 in use. The present invention provides a cantilevered soap dish 10 having a back wall support portion 12 that is mountable to a structure, using any means well known within the art, with a soap bar receptacle plate 14 angularly depending from the back wall support 12. The soap bar receptacle plate 14 has opposing side lips 16 with a front lip 18 extending therebetween. The front lip 18 provides for at least one water egress recess 22 for water to drain from the soap receptacle 11. As illustrated the soap dish 10 can be mounted for bath tub 34 use.

FIG. 8 is an illustrative view of the mountable soap dish 10. The present invention provides a cantilevered soap dish 10 having a back wall support portion 12 that is mountable to a structure, using any means well known within the art, with a soap bar receptacle plate 14 angularly depending from the back wall support 12. The soap bar receptacle 11 has opposing side lips 16 with a front lip 18 extending therebetween. The front lip 18 provides for at least one water egress recess 22 for water to drain from the soap receptacle portion. Furthermore, triangular protrusions 26 and linear protrusions 28 are provided on the top surface of the receptacle plate 14.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A mountable, cantilevered soap dish comprising:

a) a back support plate having a top edge, a bottom edge, two side edges, a front portion and a rear portion, said rear portion being completely flat for mounting on a flat, vertical wall;

b) a substantially flat receptacle plate depending angularly downward from said bottom edge of said back support plate, said rear portion of said back support plate having a straight edge corresponding with a bottom straight edge of said receptacle plate;

c) an upwardly extending front lip depending at substantially a right angle from said receptacle plate from a straight front edge of said receptacle plate;

d) opposing straight side lips depending vertically from sides of said receptacle plate, said side lips having rear edges extending diagonally away from said back support plate;

e) means for draining liquid from said soap dish comprising a water egress recess formed by said front lip having a diagonally extending side edge; and f) means for mounting said soap dish to a wall structure.

2. The mountable, cantilevered soap dish according to claim 1, wherein said liquid drainage means is at least one water egress recess.

3. The mountable, cantilevered soap dish according to claim 2, wherein said at least one water egress recess is a plurality of water egress recesses.

4. The mountable, cantilevered soap dish according to claim 2, wherein said side lips also have at least one water egress recess disposed therein.

5. The mountable, cantilevered soap dish according to claim 1, wherein said side lips assume a trapezoidal configuration.

6. The mountable, cantilevered soap dish according to claim 2, wherein said front lip is divided into two trapezoidal portions.

7. The mountable, cantilevered soap dish according to claim 1, wherein said mounting means is a peel off backing that when removed reveals an adhesive element to selectively adhere said soap dish to said wall structure.

8. The mountable, cantilevered soap dish according to claim 1, wherein the top surface of said receptacle plate has a plurality of at least two different types of protrusions projecting therefrom, said protrusions all being spaced in all directions from each other and spaced from all side and front edges of said receptacle plate.

9. The mountable, cantilevered soap dish according to claim 8, wherein said plurality of projecting protrusions are triangular in shape.

10. The mountable, cantilevered soap dish according to claim 8, wherein said plurality of projecting protrusions are linear.

11. The mountable, cantilevered soap dish according to claim 8, wherein said plurality of projecting protrusions are a combination of triangular and linear in shape.

12. A cantilevered soap dish mountable for use with a bathtub or shower stall consisting of:

a) a substantially flat back support plate having a top edge, a bottom edge, two side edges, a front portion and a rear portion, said rear portion being completely flat for mounting on a flat, vertical wall;

b) a substantially flat cantilevered receptacle plate depending angularly downward from said bottom edge of said back support plate, said rear portion of said back support plate having a straight edge corresponding with a bottom straight edge of said receptacle plate;

c) an upwardly extending front lip depending at a right angle from said receptacle plate from a straight front edge of said receptacle plate;

d) opposing straight trapezoidal side lips depending vertically from sides of said receptacle plate, said side lips having rear edges extending diagonally away from said back support plate;

e) at least one upwardly diverging water egress recess disposed in said front lip for draining liquid from the receptacle formed by at least one side edge of said front lip extending diagonally from said receptacle plate;

f) a peel and stick adhesive backing disposed on said rear portion of said back support plate for mounting said soap dish to a wall structure; and g) a plurality of triangular and linear protrusions projecting from the top portion of said receptacle plate, said protrusions all being spaced in all directions from each other and spaced from all side and front edges of said receptacle plate.

13. The cantilevered soap dish mountable for use with a bathtub or shower stall according to claim 12, wherein there is a water egress disposed in said front lip adjacent each distal corner of said receptacle plate with both side and front lips having edges extending both upwardly and outwardly forming said water egress recess.

* * * * *